US009324522B2

(12) United States Patent
Nakamura et al.

(10) Patent No.: US 9,324,522 B2
(45) Date of Patent: Apr. 26, 2016

(54) CONDUCTION BREAKING DEVICE

(71) Applicant: TOYODA GOSEI CO., LTD., Kiyosu-shi, Aichi-ken (JP)

(72) Inventors: Yoshiki Nakamura, Kiyosu (JP); Takaki Fukuyama, Kiyosu (JP); Yoshiaki Kameda, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 307 days.

(21) Appl. No.: 13/966,332

(22) Filed: Aug. 14, 2013

(65) Prior Publication Data

US 2014/0061011 A1 Mar. 6, 2014

(30) Foreign Application Priority Data

Aug. 29, 2012 (JP) ..... 2012-188794

(51) Int. Cl.
*H01H 39/00* (2006.01)

(52) U.S. Cl.
CPC ..... *H01H 39/006* (2013.01); *H01H 39/00* (2013.01); *H01H 39/002* (2013.01); *H01H 39/004* (2013.01); *H01H 2039/008* (2013.01)

(58) Field of Classification Search
CPC ... H01H 39/00; H01H 39/002; H01H 39/004; H01H 39/006; H01H 2039/008
USPC ..... 337/30, 157, 401, 405; 361/115; 200/61.08
See application file for complete search history.

(56) References Cited

U.S. PATENT DOCUMENTS

| | | | | | |
|---|---|---|---|---|---|
| 3,277,255 | A | * | 10/1966 | Mattsson et al. | 200/61.08 |
| 3,660,794 | A | * | 5/1972 | Brizzolara | 337/401 |
| 3,873,786 | A | * | 3/1975 | Lagofun | 200/61.08 |
| 3,915,236 | A | * | 10/1975 | Stichling | 169/61 |
| 3,932,717 | A | * | 1/1976 | Dike et al. | 200/61.08 |
| 4,224,487 | A | * | 9/1980 | Simonsen | 200/61.08 |
| 4,311,890 | A | * | 1/1982 | Schroder | 200/61.08 |
| 4,417,519 | A | * | 11/1983 | Lutz | 102/263 |
| 4,563,556 | A | * | 1/1986 | Goldstein | 200/82 B |
| 5,070,787 | A | * | 12/1991 | Weldon et al. | 102/216 |
| 5,535,842 | A | * | 7/1996 | Richter et al. | 180/279 |
| 5,877,563 | A | * | 3/1999 | Krappel et al. | 307/10.1 |
| 6,194,988 | B1 | * | 2/2001 | Yamaguchi et al. | 337/157 |
| 6,222,439 | B1 | * | 4/2001 | Tanigawa et al. | 337/401 |
| 6,232,568 | B1 | * | 5/2001 | Hasegawa et al. | 200/61.08 |

(Continued)

FOREIGN PATENT DOCUMENTS

| | | | |
|---|---|---|---|
| CN | 101796604 | A | 8/2010 |
| CN | 102623244 | A | 8/2012 |

(Continued)

OTHER PUBLICATIONS

Office Action mailed Mar. 30, 2015 in the corresponding CN application No. 201310369388.8 (English translation attached).

*Primary Examiner* — Anatoly Vortman
(74) *Attorney, Agent, or Firm* — Posz Law Group, PLC

(57) ABSTRACT

A conduction breaking device is provided that uses gas from a gas generator to move a cutter block in the thickness direction of a cuttable portion, thereby cutting the cuttable portion between the moving cutter block and a cutting edge portion of a cutting chamber. The cutter block is attached to the cuttable portion such that, before generation of gas by the gas generator, a part of the cutter block is located in the cutting chamber and at a position close to the cutting edge portion in a direction along the surface of the cuttable portion.

7 Claims, 9 Drawing Sheets

(56) References Cited

U.S. PATENT DOCUMENTS

| | | | | |
|---|---|---|---|---|
| 6,295,930 | B1 * | 10/2001 | Kume et al. | 102/202.5 |
| 6,483,420 | B1 * | 11/2002 | Takahashi et al. | 337/401 |
| 6,556,119 | B1 * | 4/2003 | Lell | 337/157 |
| 6,843,157 | B2 * | 1/2005 | Hamilton et al. | 83/639.4 |
| 7,123,124 | B2 * | 10/2006 | Caruso et al. | 337/157 |
| 7,205,879 | B2 * | 4/2007 | Kordel et al. | 337/401 |
| 7,222,561 | B2 * | 5/2007 | Brede et al. | 83/639.4 |
| 7,511,600 | B2 | 3/2009 | Von Behr et al. | |
| 7,745,745 | B2 * | 6/2010 | Kordel et al. | 200/61.08 |
| 7,772,958 | B2 * | 8/2010 | Schlotzer | 337/157 |
| 8,432,246 | B2 * | 4/2013 | Suzuki et al. | 337/157 |
| 8,716,615 | B2 | 5/2014 | Fukuyama et al. | |
| 2004/0041682 | A1 * | 3/2004 | Pasha et al. | 337/401 |
| 2006/0145808 | A1 | 7/2006 | Von Behr et al. | |
| 2010/0219162 | A1 | 9/2010 | Gentsch | |
| 2012/0194954 | A1 * | 8/2012 | Fukuyama et al. | 361/62 |
| 2013/0056344 | A1 * | 3/2013 | Borg | 200/81 R |
| 2013/0255463 | A1 | 10/2013 | Ukon et al. | |
| 2013/0255464 | A1 * | 10/2013 | Ukon et al. | 83/639.1 |
| 2014/0061161 | A1 * | 3/2014 | Nakamura et al. | 218/26 |
| 2014/0062185 | A1 * | 3/2014 | Nakamura et al. | 307/10.1 |

FOREIGN PATENT DOCUMENTS

| | | | |
|---|---|---|---|
| DE | 102006032605 | A1 | 11/2007 |
| JP | 4228063 | B2 | 12/2008 |
| JP | 4344255 | B2 | 7/2009 |
| JP | 2012-138282 | A | 7/2012 |
| JP | 2012-151091 | A | 8/2012 |
| WO | 2011/114045 | A1 | 9/2011 |

* cited by examiner

CONDUCTION BREAKING DEVICE

BACKGROUND OF THE INVENTION

The present invention relates to a conduction breaking device for breaking conduction between a pair of devices in an electric circuit by cutting a metal conductive body extending between the devices.

Electric circuits are provided with a conduction breaking device for breaking conduction between devices by being activated when malfunction occurs in a device in the electric circuit or a system on which the electric circuit is mounted. As one form thereof, a conduction breaking device has been proposed that forcibly cuts a metal conductive body located between devices by moving a blade with gas (see Japanese Patent Nos. 4228063 and 4344255, for example).

This type of conduction breaking device has a basic structure as illustrated in FIG. 16. A conduction breaking device C includes a metal conductive body 81 having a cuttable portion 81A, a cutting chamber 82, a gas generator 83, and a cutter block 84. The cutting chamber 82 and the gas generator 83 are arranged to sandwich the cuttable portion 81A in the thickness direction (the up-down direction as viewed in FIG. 16). The cutting chamber 82 has a rectangular opening 85, which faces the cuttable portion 81A, and a side of the opening 85 forms a cutting edge portion 86. An accommodating chamber 87 is formed between the cuttable portion 81A and the gas generator 83. The cutter block 84 is arranged in the accommodating chamber 87 to be movable in the thickness direction of the cuttable portion 81A.

When the gas generator 83 of the conduction breaking device C receives an activation signal, the gas generator 83 generates gas. The gas pushes the cutter block 84 toward the cutting chamber 82, so that the cuttable portion 81A is cut between the cutting edge portion 86 and the cutter block 84. Accordingly, the conduction between devices is broken.

SUMMARY OF THE INVENTION

To properly cut the cuttable portion 81A of the conduction breaking device C, it is important to reduce the distance between the cutter block 84 and cutting edge portion 86 to a significantly small value in the direction along the surface of the cuttable portion 81A (the lateral direction as viewed in FIG. 16). The greater the distance, the more likely that cutting of the cuttable portion 81A will be poorly executed.

In this respect, in the conduction breaking device C according to the conventional art including Japanese Patent Nos. 4228063 and 4344255, the entire cutter block 84 is located in the accommodating chamber 87, which is located on the opposite side of the cuttable portion 81A from the cutting chamber 82, prior to generation of gas by the gas generator 83. Therefore, to ensure that there is an adequate clearance between the cutter block 84 and the cutting edge portion 86 in the direction along the surface of the cuttable portion 81A when the cutter block 84 is moved toward the cutting chamber 82 by gas, the positions of the respective components, for example, the positions of the cutter block 84 with respect to the accommodating chamber 87 need to be adjusted accurately. Such adjustment of positions involves a complicated process.

Accordingly, it is an objective of the present invention to provide a conduction breaking device that allows the position of a cutter block to be easily adjusted to achieve stable cutting performance.

To achieve the foregoing objective, and in accordance with one aspect of the present invention, a conduction breaking device for breaking conduction between a pair of devices in an electric circuit is provided. The conduction breaking device has an elongated plate-shaped metal conductive body, a cutting chamber, a gas generator, and a cutter block. The metal conductive body extends between the devices in the electric circuit and has a cuttable portion in part in a longitudinal direction. The cutting chamber and the gas generator face each other to sandwich the cuttable portion in the thickness direction of the cuttable portion. The cutter block is movable in the thickness direction of the cuttable portion. The cutting chamber has a polygonal opening that faces the cuttable portion. At least one side of the opening forms a cutting edge portion. The gas generator generates gas to move the cutter block in the thickness direction of the cuttable portion, thereby cutting the cuttable portion between the moving cutter block and the cutting edge portion. The cutter block is attached to the cuttable portion such that, before generation of gas by the gas generator, a part of the cutter block is located in the cutting chamber and at a position close to the cutting edge portion in a direction along the surface of the cuttable portion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A conduction breaking device C according to one embodiment of the present invention will now be described with reference to FIGS. 1 to 6.

Figure 2:
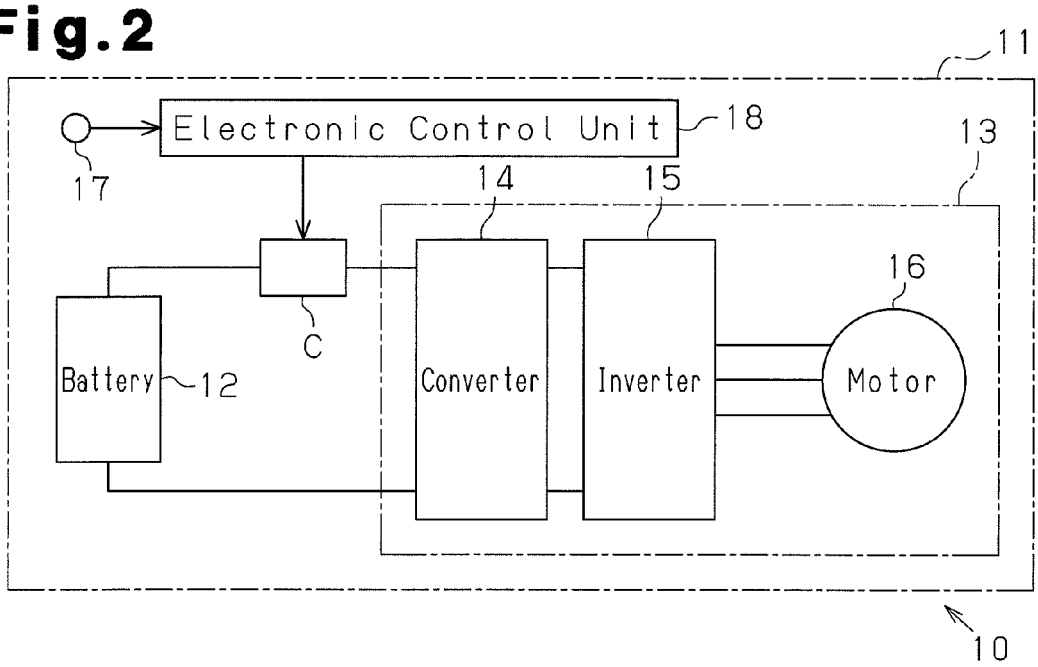
FIG. 2 is a diagram illustrating a schematic structure of an electric circuit to which the conduction breaking device according to the embodiment of FIG. 1 is applied.

FIG. 2 shows an electric circuit 11, in which the conduction breaking device C of the present embodiment is incorporated. The electric circuit 11 includes as its components a storage battery 12 and an electric device 13. In the electric circuit 11, the electric device 13 is operated by DC electricity supplied from the storage battery 12. The electric device 13 is configured by a converter 14, which increases the voltage of electricity input from the storage battery 12 and outputs the increased voltage, an inverter 15, which converts DC electricity input from the converter 14 into AC electricity suitable for driving a motor and outputs the AC electricity, and a motor 16, which is driven by the AC electricity output from the inverter 15.

The electric circuit 11 is mounted on a vehicle 10. When the vehicle 10 is damaged, for example, by a collision, the electric device 13 may not properly operate or current leakage from the electric circuit 11 may be caused. Thus, the vehicle 10 is provided with the conduction breaking device C that breaks, at a collision of the vehicle, conduction between devices in the electric circuit 11, such as between the storage battery 12 (specifically, its positive electrode) and the electric device 13. The vehicle 10 includes a collision sensor 17 for detecting presence of a collision and outputting the detected result as an output signal and an electronic control unit 18, which is configured mainly of a microcomputer and receives the output signal of the collision sensor 17. Then, when detecting a collision of the vehicle 10 based on an output signal of the collision sensor 17, the electronic control unit 18 activates the conduction breaking device C. Accordingly, supply of electricity from the storage battery 12 to the electric device 13 is discontinued.

Figure 1:
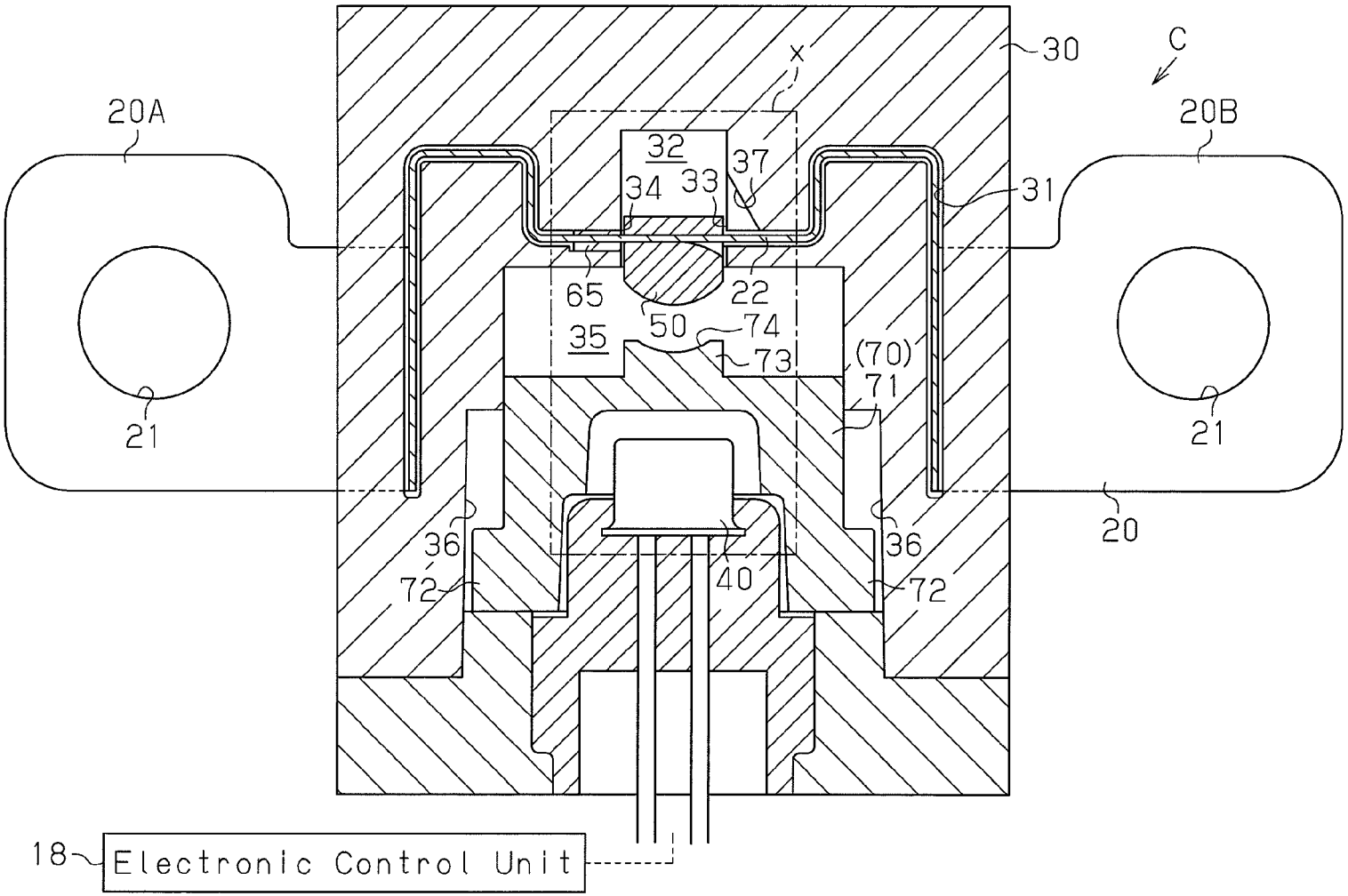
FIG. 1 is a cross-sectional view illustrating the internal structure of a conduction breaking device according to one embodiment of the present invention.

As illustrated in FIG. 1, the conduction breaking device C includes a metal conductive body 20, a case 30, an explosive type gas generator 40, a cutter block 50, a restraining block 65, and a hammer 70. The components in the conduction breaking device C will be described below.

<Metal Conductive Body 20>

The metal conductive body 20 forms a conduction path for establishing conduction between devices of the electric circuit 11 (between the storage battery 12 and the electric device 13). The metal conductive body 20 is formed in an elongated plate shape and is made of a metal material having a high electric conductivity. As such metal material, copper is desirable, but other material such as brass or aluminum may be used. The metal conductive body 20 has a pair of external connectors 20A and 20B formed at both ends thereof. The external connectors 20A and 20B are connected to the storage battery 12 and the electric device 13 (the converter 14), respectively. The external connectors 20A, 20B each have a through hole 21. A fastener such as a screw is inserted in each through hole 21 so that one of the external connectors 20A and 20B is connected to a terminal conductive with the storage battery 12 and the other is connected to a terminal conductive with the electric device 13 (the converter 14). In this way, the metal conductive body 20 is connected to the terminals of the storage battery 12 and the converter 14 in the electric circuit 11, respectively, via the external connectors 20A and 20B, so that the terminals are electrically connected to each other via the conductive body 20.

The metal conductive body 20 has a cuttable portion 22 at a part in the longitudinal direction (middle part). The cuttable portion 22 extends between the external connectors 20A and 20B in their arrangement direction (in the lateral direction as viewed in FIG. 1). The direction in which the cuttable portion 22 extends, or the direction in which the external connectors 20A and 20B are arranged, is denoted as a longitudinal direction of the cuttable portion 22.

<Case 30>

The case 30 is made of a plastic material having an electrical insulating property and a high strength. The case 30 includes an arrangement portion 31, in which the metal conductive body 20 is arranged. The metal conductive body 20 is arranged in the arrangement portion 31 with the external connectors 20A and 20B exposed to the outside of the case 30. The case 30 includes a cutting chamber 32 on one side of the cuttable portion 22 in the thickness direction (the vertical direction of FIG. 1), and an accommodating chamber 35 on the other side.

Figure 3:
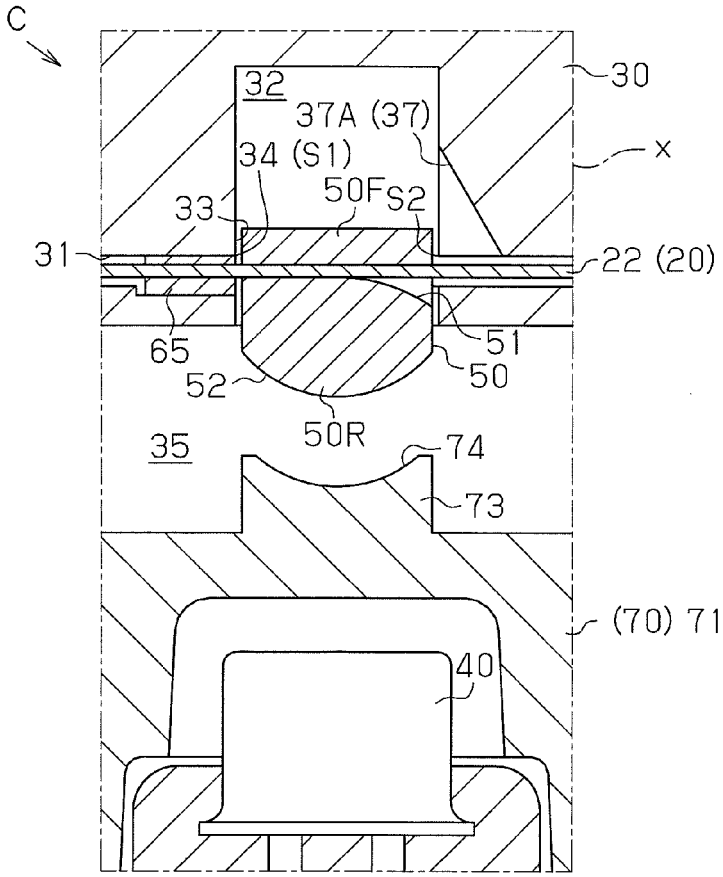
FIG. 3 is an enlarged partial cross-sectional view illustrating section x of FIG. 1.
Figure 4:
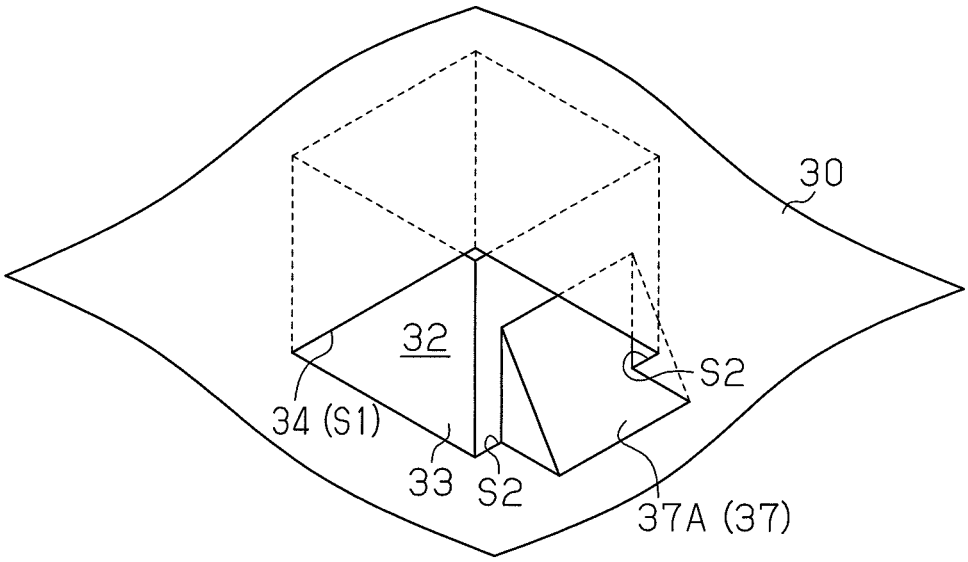
FIG. 4 is a partial perspective view as viewed from diagonally below, illustrating the cutting chamber and the cutout portion in the conduction breaking device of FIG. 1.

Part of the cutter block 50 is arranged in the cutting chamber 32, and cutting of the cuttable portion 22 is executed in the cutting chamber 32 by the cutter block 50. As shown in FIGS. 3 and 4, the cutting chamber 32 has a rectangular (square in the present embodiment) opening 33, which faces the cuttable portion 22. A side of the opening 33 at one end in the direction along the surface of the cuttable portion 22, more specifically, at one end in the longitudinal direction of the cuttable portion 22 (the left end as viewed in FIGS. 3 and 4) is referred to as a first side S1. The first side S1 forms a cutting edge portion 34.

As shown in FIG. 1, the accommodating chamber 35 extends in the thickness direction of the cuttable portion 22. Guide grooves 36, which extend in the thickness direction, are formed in inner wall surfaces of the accommodating chamber 35.

As shown in FIGS. 3 and 4, the other side of the opening 33 in the longitudinal direction of the cuttable portion 22 is referred to as a second side S2. In the vicinity of the second side S2, a cutout portion 37 is formed that can receive the cuttable portion 22. In the present embodiment, the cutout portion 37 has an inclined surface 37A, which is inclined such that the distance from the cutting edge portion 34 decreases as the distance from the cuttable portion 22 in the thickness direction of the cuttable portion 22 increases.

<Gas Generator 40>

As shown in FIG. 1, the gas generator 40 is used as a drive source of the conduction breaking device C. The gas generator 40 is arranged in the case 30 with a part thereof exposed to the accommodating chamber 35. The gas generator 40 is connected to the electronic control unit 18. The gas generator 40 receives an activation signal from the electronic control unit 18 when gas is to be generated. The gas generator 40 ignites and burns the incorporated explosive in response to the input activation signal from the electronic control unit 18, thereby generating gas.

A device driven by use of the explosive type gas generator 40 can be more quickly driven, and is of lower costs and more reliable in its operation than a device using another system (such as electromagnetic one) as a drive source.

<Cutter Block 50>

As shown in FIG. 3, the cutter block 50 cooperates with the cutting edge portion 34 to cut the cuttable portion 22. The cutter block 50 is made of a plastic material having an electrical insulating property and a high strength. The cutter block 50 covers part of the cuttable portion 22 in the longitudinal direction (part that is arranged in the cutting chamber 32).

The cutter block 50 includes a block leading portion 50F (the upper section as viewed in FIG. 3), which covers a surface of the cuttable portion 22 that faces the cutting chamber 32, and a block trailing portion 50R (the lower section as viewed in FIG. 3), which covers a surface of the cuttable portion 22 that faces the accommodating chamber 35. The block leading portion 50F is located on the leading side in the moving direction of the cutter block 50 when cutting is performed, and the block trailing portion 50R is located on the trailing side in the movement direction of the block 50 when cutting is performed. The block leading portion 50F is located further away from the gas generator 40 than the cuttable portion 22, and the block trailing portion 50R is located closer to the gas generator 40 than the cuttable portion 22.

The cutter block 50 is attached to the cuttable portion 22 such that, before generation of gas by the gas generator 40, the block leading portion 50F of the cutter block 50 is located in the cutting chamber 32 and at a position close to the cutting edge portion 34 in the direction along the surface of the cuttable portion 22 (the longitudinal direction). In the present embodiment, the metal conductive body 20 is placed as an insert piece in a mold for plastic. Molten molding material is molded in the mold (insert molding) to form the cutter block 50. In this manner, the cutter block 50 is formed integrally with and fixed to the cuttable portion 22.

The above mentioned "position close to the cutting edge portion 34" refers to a position separated from the cutting edge portion 34 by a distance that is suitable for the cutter block 50 to cooperate with the cutting edge portion 34 to cut (shear) the cuttable portion 22. The distance is preferably 1 mm or less, and more preferably 0.5 mm or less. The distance is further preferably 0.2 mm or less.

The block trailing portion 50R has a curved surface 51 at a boundary with the cuttable portion 22. Specifically, the curved surface 51 is located in the vicinity of the second side S2 of the opening 33 in the longitudinal direction of the cuttable portion 22. The curved surface 51 is curved to bulge toward the cuttable portion 22. The distance between the curved surface 51 and the cuttable portion 22 increases as the distance from the second side S2 decreases in the longitudinal direction of the cuttable portion 22.

The dimension of the block leading portion 50F in the longitudinal direction of the cuttable portion 22 is slightly smaller than the dimension of the opening 33 in the same direction. Therefore, when the block leading portion 50F is arranged in the opening 33, the block leading portion 50F is engaged with (fitted into) the opening 33. By setting the dimensions of the block leading portion 50F and the opening 33 in the longitudinal direction of the cuttable portion 22 such that the block leading portion 50F can be engaged with the opening 33, the opening 33 is formed as an engageable portion and the block leading portion 50F is formed as an engaging portion. By engaging the block leading portion 50F (the engaging portion) with the opening 33 (the engageable portion), the position of the cutter block 50 is determined in the direction toward and away from the cutting edge portion 34, that is, in the direction along the surface of the cuttable portion 22 (longitudinal direction).

Before generation of gas by the gas generator 40, the block trailing portion 50R of the cutter block 50 is located in the accommodating chamber 35. The block trailing portion 50R has, at a position facing the gas generator 40, a curved surface 52 bulging toward the gas generator 40.

<Restraining Block 65>

Figure 5:
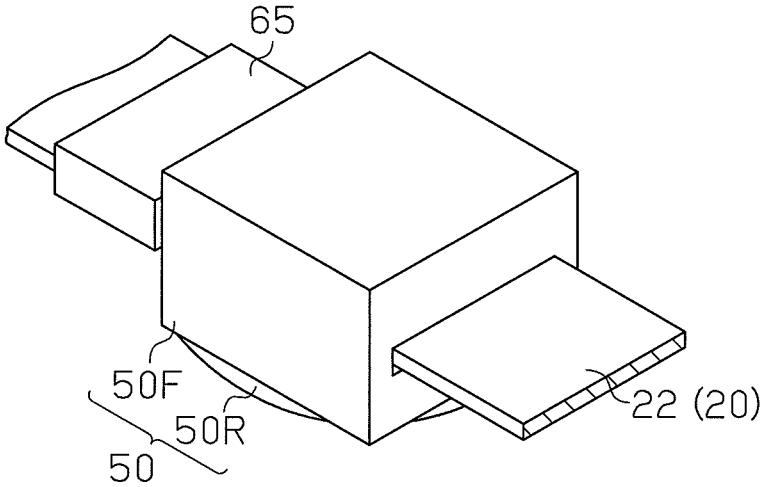
FIG. 5 is a partial perspective view as viewed from diagonally above, illustrating the metal conductive body, the cutter block, and the restraining block in the conduction breaking device of FIG. 1.

As shown in FIGS. 3 and 5, the restraining block 65 is located at a position on the opposite side of the cutting edge portion 34 from the cutter block 50 (on the left side as viewed in FIGS. 3 and 5) in the direction along the surface of the cuttable portion 22 (the longitudinal direction). At the position, the restraining block 65 restricts movement of the cuttable portion 22. The restraining block 65 is made of a plastic material having an electrical insulating property and a high strength. In the present embodiment, the restraining block 65 is formed through insert molding in which the metal conductive body 20 is used as an insert piece. The dimension of the restraining block 65 in the thickness direction of the cuttable portion 22 (the vertical direction as viewed in FIGS. 3 and 5) is set to be substantially equal to the dimension of the arrangement portion 31 at a position at which the restraining block 65 is located. In this manner, the restraining block 65 is formed integrally with and fixed to the cuttable portion 22, like the cutter block 50. The restraining block 65 is arranged in the arrangement portion 31, and the restraining block 65 and the cutter block 50 sandwich the cutting edge portion 34 in the direction along the surface of the cuttable portion 22 (the longitudinal direction).

<Hammer 70>

As shown in FIG. 1, the hammer 70 is accommodated in the accommodating chamber 35 and located between the cutter block 50 and the gas generator 40 to be movable in the thickness direction of the cuttable portion 22. The hammer 70 is made of a plastic material having an electrical insulating property and a high strength. The hammer 70 includes a main body 71 and guide projections 72, which project from the outer surface of the main body 71 in the thickness direction of the cuttable portion 22. Most of the hammer 70 is formed by the main body 71. The guide projections 72 are engaged with the guide grooves 36 of the accommodating chamber 35 to be moveable in the thickness direction of the cuttable portion 22. The hammer 70 has a striking portion 73, which projects from the center of the main body 71 toward the cutting chamber 32 and is configured to strike the cutter block 50. The striking portion 73 has a concave surface 74, which is recessed as a curved surface.

The conduction breaking device C of the present embodiment is constructed as described above. Operation of the conduction breaking device C will now be described.

In the conduction breaking device C, the cutter block 50 is fixed to the cuttable portion 22, and the block leading portion 50F of the cutter block 50 is located in the cutting chamber 32 and at a position close to the cutting edge portion 34 in the direction along the surface of the cuttable portion (the longitudinal direction). Therefore, during manufacture (assembly) of the conduction breaking device C, it is possible to directly regulate the clearance between the block leading portion 50F and the cutting edge portion 34 in the direction along the surface of the cuttable portion 22 (longitudinal direction). Thus, the position of the block leading portion 50F can be easily adjusted with respect to the cutting edge portion 34 in the direction along the surface of the cuttable portion 22 (the longitudinal direction), such that the block leading portion 50F is arranged close to the cutting edge portion 34.

In the present embodiment, the cutter block 50 includes the block leading portion 50F, which is located further away from the gas generator 40 than the cuttable portion 22. By engaging the block leading portion 50F (the engaging portion) of the cutter block 50 with the opening 33 (the engageable portion) of the cutting chamber 32, the position of the cutter block 50 in the direction toward and away from the cutting edge portion 34 (the longitudinal direction of the cuttable portion 22) is determined.

Figure 16:
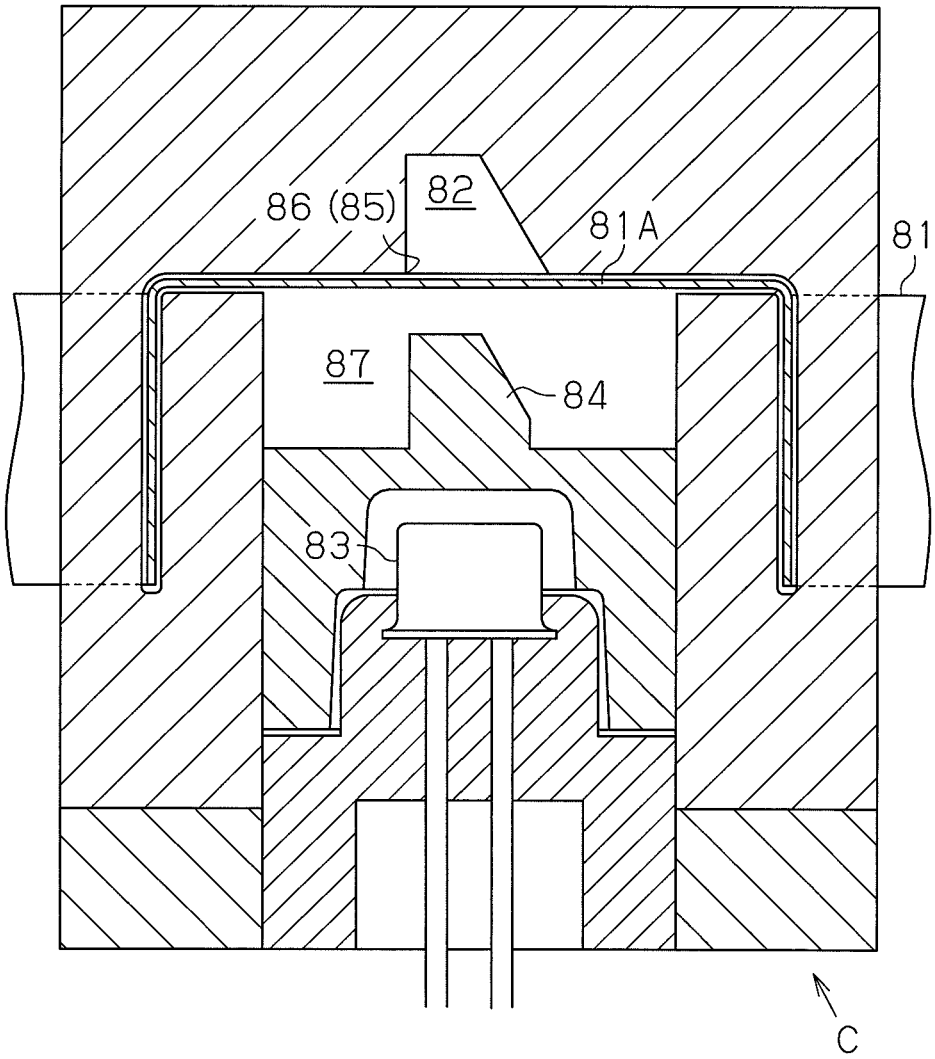
Fig.16(Prior Art)
FIG. 16 is a partial cross-sectional view illustrating the internal structure of a conventional conduction breaking device.

In this respect, the conduction breaking device C of the present embodiment is advantageous over the conduction breaking devices of Japanese Patent Nos. 4228063 and 4344255. As shown in FIG. 16, in the conduction breaking device described in Japanese Patent Nos. 4228063 and 4344255, the entire cutter block 84 is located closer to the gas generator 83 than the cuttable portion 81A. In this case, it is impossible to directly regulate the clearance between the cutter block 84 and the cutting edge portion 86 in the direction along the surface of the cuttable portion 81A.

When no collision of the vehicle 10 is detected by the collision sensor 17, no activation signal is output from the electronic control unit 18 to the gas generator 40, and gas is not generated from the gas generator 40. At this time, as shown in FIGS. 1 and 3, the striking portion 73 is separated from the block trailing portion 50R and is located in the vicinity of the gas generator 40.

When a collision of the vehicle 10 is detected by the collision sensor 17, the electronic control unit 18 sends an activation signal to the gas generator 40. In response to the activation signal, the gas generator 40 is activated and generates gas. The hammer 70, which is located between the cutter block 50 and the gas generator 40, receives pressure of the gas directed toward the cutter block 50. At this time, the guide projections 72 are moved along the guide grooves 36 of the accommodating chamber 35, so that the hammer 70 is guided toward the cutter block 50 in the thickness direction of the cuttable portion 22.

The hammer 70 is moved so that the striking portion 73 strikes the curved surface 52 of the block trailing portion 50R at the concave surface 74. That is, the hammer 70 pushes the cutter block 50 toward the cutting chamber 32. In the cutter block 50, the block leading portion 50F, which is located in the cutting chamber 32 before the generation of gas is moved away from the gas generator 40 in the thickness direction of the cuttable portion 22 in the vicinity of the cutting edge portion 34.

Figure 6:
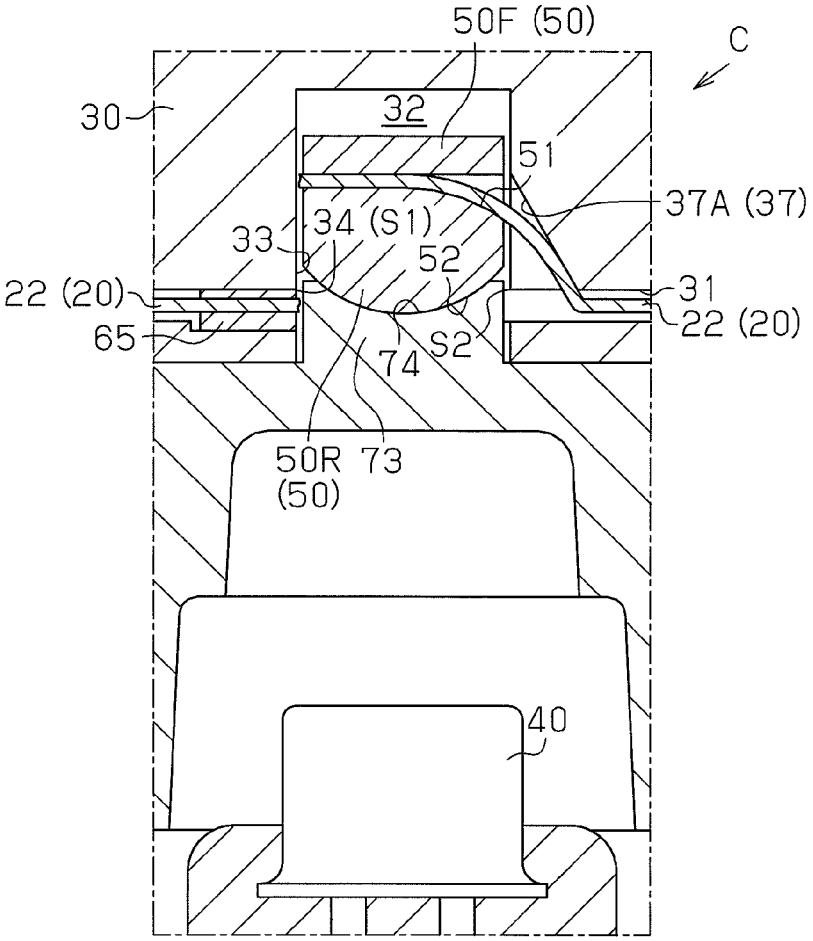
FIG. 6 is a partial cross-sectional view illustrating a state in which the metal conductive body in FIG. 3 has been cut.

At this time, as shown in FIG. 6, the part of the cuttable portion 22 to which the cutter block 50 is fixed and the block trailing portion 50R are moved toward the cutting chamber 32. Accordingly, stress acts on a part of the cuttable portion 22 that is in the vicinity of the cutting edge portion 34 in a concentrated manner, so that the part is cut.

At this time, since part of the cuttable portion 22 that is covered with the cutter block 50 is fixed to the cutter block 50, the part is prevented from being stretched relative to the cutter block 50. This suppresses a phenomenon in which movement of the cutter block 50 stretches the cuttable portion 22 in the vicinity of the cutting edge portion 34.

The restraining block 65 is located at a position on the opposite side of the cutting edge portion 34 from the cutter block 50 (on the left side as viewed in FIG. 6) in the direction along the surface of the cuttable portion 22 (the longitudinal direction). At the position, the restraining block 65 restricts movement of the cuttable portion 22. Movement of the cuttable portion 22 includes movement in the direction along the surface of the cuttable portion 22 and movement in the thickness direction of the cuttable portion 22. The movement in the direction along the surface of the cuttable portion 22 includes stretching in the direction along the surface of the cuttable portion 22. This suppresses a phenomenon in which movement of the cutter block 50 stretches the cuttable portion 22 in the vicinity of the cutting edge portion 34.

Particularly, since movement of the cuttable portion 22 is restricted at both sides sandwiching the cutting edge portion 34 in the direction along the surface of the cuttable portion 22 (the longitudinal direction), stretching of the cuttable portion 22 is efficiently restricted in the vicinity of the cutting edge portion 34.

Also since the cutter block 50 and the cutting edge portion 34 are separated from each other in the direction along the surface of the cuttable portion 22 by an adequate distance, the part of the cuttable portion 22 between the cutter block 50 and the cutting edge portion 34 that receives stress is cut in a stable manner. Accordingly, the conduction between the external connectors 20A and 20B is broken, so that the storage battery 12 and the converter 14 are electrically disconnected from each other.

If the first side S1 and the second side S2 of the rectangular opening 33 each form a cutting edge portion 34, and the block leading portion 50F of the cutter block 50 is located close to both cutting edge portions 34 in the direction along the surface of the cuttable portion 22, the cutter block 50 cuts the cuttable portion 22 at two positions. In this case, compared to the case in which the cutter block 50 cuts the cuttable portion 22 at one position, the cutter block 50 needs to be moved toward the cutting chamber 32 with double load. That is, a relatively great load is required.

In this respect, in the present embodiment, the cutout portion 37 is provided in the vicinity of the second side S2 of the rectangular opening 33 as shown in FIGS. 4 and 6. Thus, when the gas from the gas generator 40 pushes the cutter block 50 toward the cutting chamber 32, the cuttable portion 22 is cut between the cutting edge portion 34 and the cutter block 50. In addition, the cuttable portion 22 is pushed by the cutter block 50 to be warped along the curved surface 51 of the block trailing portion 50R. At the same time, the cuttable portion 22 enters the cutout portion 37 to be deformed (bent). The load required for the deformation is significantly smaller than the load required for cutting. Therefore, only a small load is required for moving the cutter block 50 toward the cutting chamber 32.

The above illustrated embodiment has the following advantages.

(1) The cutter block 50 is attached to the cuttable portion 22 such that, before generation of gas by the gas generator 40, part of the cutter block 50 is located in the cutting chamber 32 and at a position close to the cutting edge portion 34 in the direction along the surface of the cuttable portion 22 (the longitudinal direction) as shown in FIGS. 1 and 3.

Thus, the position of the cutter block 50 with respect to the cutting edge portion 34 in the direction along the surface of the cuttable portion 22 (the longitudinal direction) can be easily regulated. Therefore, the clearance between the cutting edge portion 34 and the cutter block 50 can be adequately adjusted, so that the cuttable portion 22 can be stably cut by the cutting edge portion 34 and the cutter block 50.

(2) The cutter block 50 is fixed to the cuttable portion 22 of the metal conductive body 20 (FIG. 5). Through insert molding in which the metal conductive body 20 is used as an insert piece, the cutter block 50 is formed integrally with the cuttable portion 22 of the metal conductive body 20, so that the cutter block 50 is fixed to the cuttable portion 22.

This suppresses stretching of the cuttable portion 22 in the vicinity of the cutting edge portion 34 due to movement of the cutter block 50. This allows the cuttable portion 22 to be easily cut.

(3) The dimension of the opening 33 in the direction along the surface of the cuttable portion 22 (the longitudinal direction) is set to be slightly larger than the dimension of the block leading portion 50F in the same direction. This structure allows the block leading portion 50F to be engaged with the opening 33. Accordingly, the opening 33 is used as an engageable portion, and the block leading portion 50F is used as an engaging portion (FIG. 3).

Therefore, by engaging the block leading portion 50F (the engaging portion) with the opening 33 (the engageable portion), the position of the cutter block 50 is determined in the direction along the surface of the cuttable portion 22, that is, in the direction toward and away from the cutting edge portion 34.

(4) The hammer 70 is provided between the cutter block 50 and the gas generator 40, and the hammer 70 is pushed by the pressure of gas from the gas generator 40 and moved toward the cutting chamber 32. The hammer 70 then strikes and moves the cutter block 50 (FIG. 3).

Therefore, the hammer 70 operates to receive the pressure of gas, and the cutter block 50 operates to cut the cuttable portion 22. The cutter block 50 and the hammer 70 are formed to have shapes suitable for the respective operations, so that the shapes of components are simplified compared to a case in which the hammer 70 is not used. The cutter block 50 and the hammer 70 may be made of materials suitable for the respective operations. For example, the cutter block 50 may be made of plastic, while the hammer 70 may be made of metal.

(5) The restraining block 65 is located at a position on the opposite side of the cutting edge portion 34 from the cutter block 50 in the direction along the surface of the cuttable portion 22 (the longitudinal direction) as shown in FIGS. 3 and 5. The restraining block 65 restricts movement of the cuttable portion 22.

This suppresses stretching of the cuttable portion 22 on the opposite side of the cutting edge portion 34 from the cutter block 50 due to movement of the cutter block 50. This allows the cuttable portion 22 to be easily cut.

Particularly, in combination with the structure of the above item (2), the cuttable portion 22 can be restrained on both sides of the cutting edge portion 34 in the direction along the surface of the cuttable portion 22 (the longitudinal direction). As a result, stretching of the cuttable portion 22 in the vicinity of the cutting edge portion 34 is efficiently suppressed, so that the cuttable portion 22 is easily cut.

(6) The cutout portion 37 for receiving the cuttable portion 22 is provided in the vicinity of the second side S2, which faces the cutting edge portion 34, of the sides of the opening 33 (FIGS. 4 and 6).

Therefore, the cuttable portion 22 can be pushed into the cutout portion 37 and deformed (bent) by the cutter block 50. When cutting and bending the cuttable portion 22, the cutter block 50 can be moved to the cutting chamber 32 by a small load.

The above embodiment may be modified as follows.

<Modification of Opening 33>

The opening 33 may be a polygon other than a rectangle.

<Modification of Cutting Edge Portion 34>

Two or more sides of the opening 33 may each form a cutting edge portion 34. For example, in the case in which the opening 33 is rectangular, two sides that face each other in the longitudinal direction of the cuttable portion 22 may each form a cutting edge portion 34 if there is no particular limit to the load required for performing cutting.

<Modification of Cutter Block 50>

The cutter block 50 is not limited to the one that is formed through insert molding in which the metal conductive body 20 is used as an insert piece. The cutter block 50 may be formed separately from the metal conductive body 20 and then attached to the cuttable portion 22.

Figure 7:
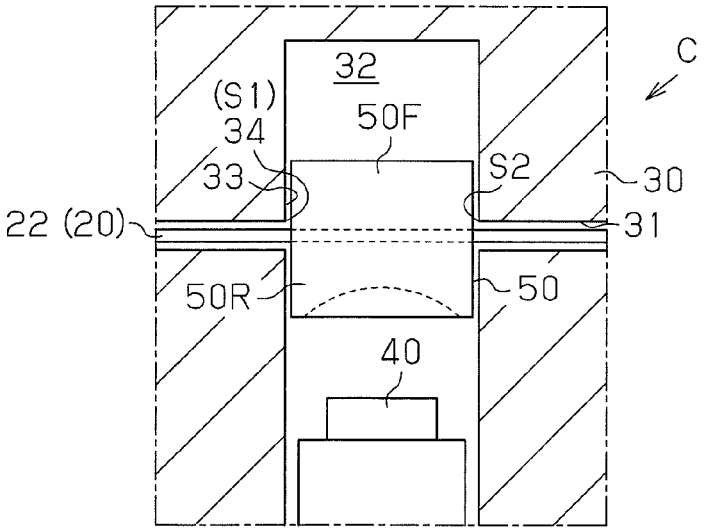
FIG. 7 is a partial cross-sectional view illustrating a modification of a conduction breaking device from which the hammer is omitted.

The cutter block 50 may be formed integrally with the hammer 70 as shown in FIG. 7.

In this case, when the gas generator 40 generates gas, the cutter block 50 directly receives the pressure of the gas at the block trailing portion 50R and is pushed toward the cutting chamber 32 together with the block leading portion 50F. Accordingly, in the block leading portion 50F, which has been located in the cutting chamber 32 before the gas generation, a part in the vicinity of the cutting edge portion 34 in the direction along the surface of the cuttable portion 22 (the longitudinal direction of the cuttable portion 22: the lateral direction as viewed in FIG. 7) is moved in the thickness direction of the cuttable portion 22.

Figure 8A:
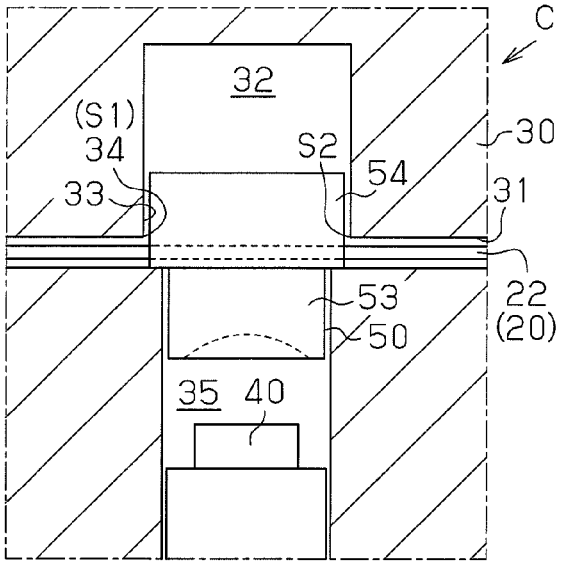
FIG. 8A is a partial cross-sectional view illustrating a modification of a cutter block.
Figure 8B:
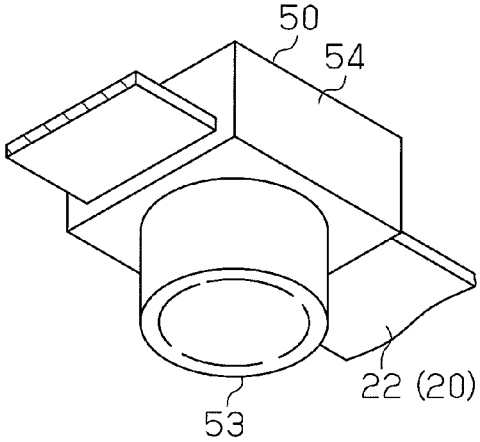
FIG. 8B is a partial cross-sectional view illustrating the cutter block of FIG. 8A.

FIGS. 8A and 8B illustrate the modification of FIG. 7. In this modification, the cutter block 50 includes a columnar pressure receiving portion 53, which receives the pressure of gas from the gas generator 40, and a rectangular parallelepiped cutting portion 54, which is located further away from the gas generator 40 than the pressure receiving portion 53. The cutting portion 54 cooperates with the cutting edge portion 34 to cut the cuttable portion 22. The accommodating chamber 35 is formed to be cylindrical. The cutting portion 54 of the cutter block 50 is attached to the cuttable portion 22.

In this case, the accommodating chamber 35 is cylindrical, the pressure receiving portion 53 is columnar, and the accommodating chamber 35 and the pressure receiving portion 53 have simple shapes. Therefore, formation of the accommodating chamber 35 and the pressure receiving portion 53 are relatively easy compared to a case where these are formed into other shapes. Also, it is relatively easy to reduce the clearance between the cylindrical accommodating chamber 35 and the columnar pressure receiving portion 53, and gas leak through the clearance can be reduced. Further, the pressure receiving portion 53, which receives the pressure of gas, is formed to be columnar, the gas pressures is prevented from being concentrated onto a specific area.

When the cuttable portion 22 is cut, two end faces are created. If the distance between the end faces is short, electric discharge may occur between the end faces. To suppress such electric discharge, the distance between the end faces may be increased.

Figure 9:
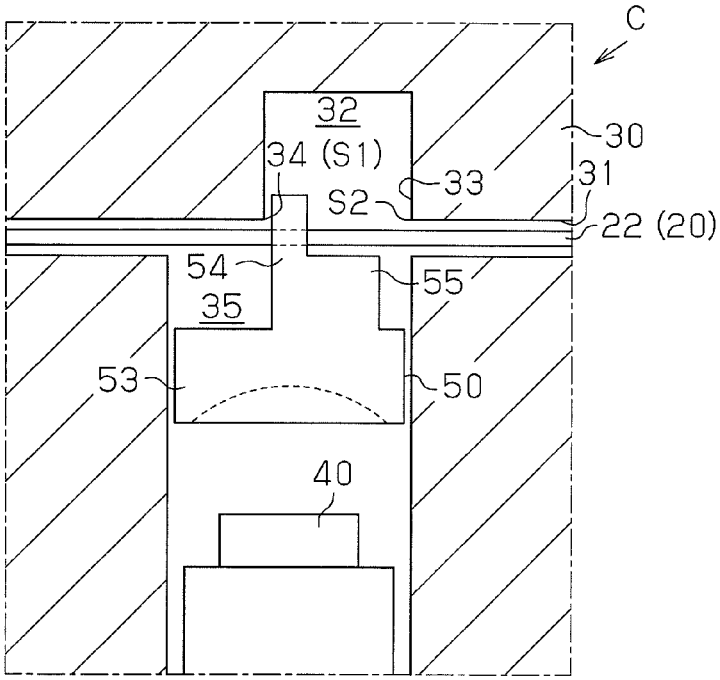
FIG. 9 is a partial cross-sectional view of a modification of a cutter block, illustrating a state before a cuttable portion is cut.
Figure 10:
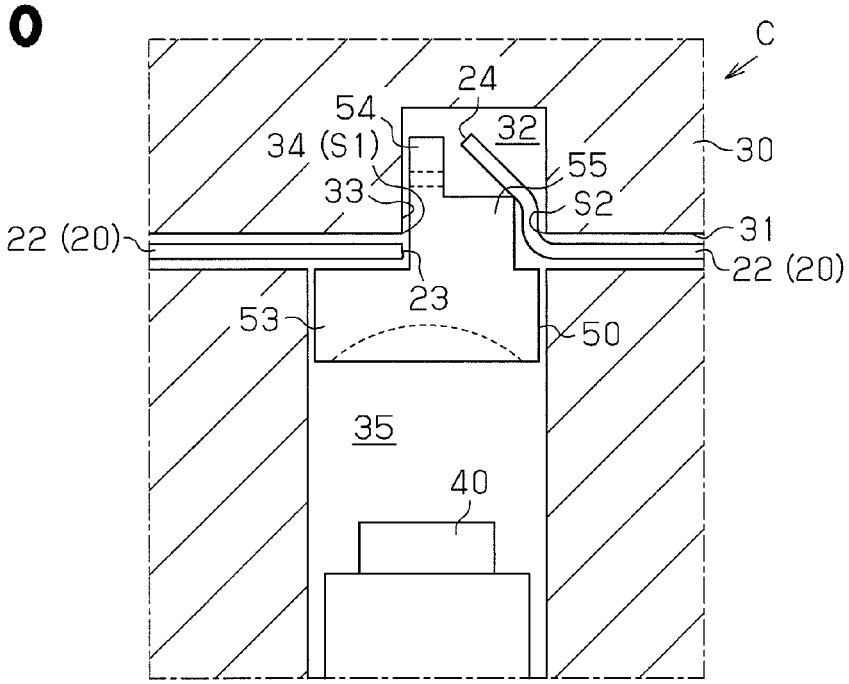
FIG. 10 is a partial cross-sectional view of the cutter block of FIG. 9, illustrating a state after the cuttable portion has been cut.

FIGS. 9 and 10 illustrate an example of a conduction breaking device C in which the distance between end faces is increased. As shown in FIG. 9, the cutter block 50 has a lifting portion 55 projecting from the pressure receiving portion 53 toward the cuttable portion 22. The lifting portion 55 is located at a position spaced away from the cutting edge portion 34 in the longitudinal direction of the cuttable portion 22.

In this modification, the cutter block 50 is not fixed to the cuttable portion 22 and is movable in the direction along the surface of the cuttable portion 22 (the longitudinal direction).

According to this modification, the cuttable portion 22 is cut by the cutting edge portion 34 and the cutter block 50 at a position close to the cutting edge 34, as shown in FIG. 10. After the cutting, part of the cuttable portion 22 that is located in the cutting chamber 32 and between the first side S1 and the second side S2 of the opening 33 is lifted by the lifting portion 55 and bent into the cutting chamber 32. The distance between end faces 23, 24 of the cuttable portion 22, which have been created through cutting, is increased by the bending.

<Modification of Engaging Portion and Engageable Portion>

The block leading portion 50F and the opening 33 do not necessarily need to be used as an engaging portion and an engageable portion. For example, an engaging portion and an engageable portion shown in FIG. 11 may be provided. In this case, the dimension of the block leading portion 50F in the longitudinal direction of the cuttable portion 22 may be significantly smaller than the dimension of the opening 33 in the same direction.

In this case, grooves 38 extending in the thickness direction of the cuttable portion 22 (the up-down direction as viewed in FIG. 11) form engageable portions, and protrusions 56 extending in the thickness direction of the cuttable portion 22 form engaging portions. The grooves 38 are formed in wall surfaces of the cutting chamber 32 that face each other in the width direction of the cuttable portion 22 (substantially the lateral direction in FIG. 11). The protrusions 56 are formed at least on the block leading portion 50F of the cutter block 50 and on opposite wall surfaces in the width direction of the cuttable portion 22.

In this modification, by engaging the protrusions 56 (the engaging portions) with the grooves 38 (the engageable portions), the position of the cutter block 50 in the direction toward and away from the cutting edge portion 34 (the longitudinal direction of the cuttable portion 22) is determined.

Figure 12:
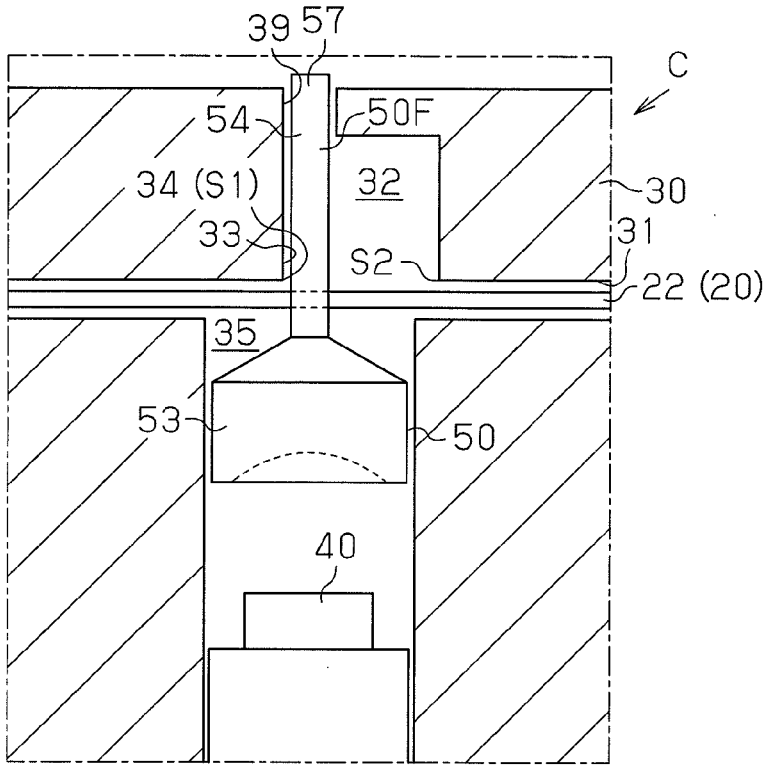
FIG. 12 is a partial cross-sectional view illustrating a modification of a cutter block.

The position of the cutter block 50 in the longitudinal direction of the cuttable portion 22 may be determined by using an engaging portion and an engageable portion illustrated in FIG. 12. In the modification illustrated in FIG. 12, the block leading portion 50F of the cutter block 50 is extended in the thickness direction of the cuttable portion 22 (the up-down direction as viewed in FIG. 12) to form an extended end 57. A hole 39 for receiving (engaging with) the extended end 57 is formed at the bottom of the cutting chamber 32. In this case, the hole 39 forms an engageable portion, and the extended end 57 forms an engaging portion. By inserting (engaging) the extended end 57 (the engaging portion) into the hole 39 (the engageable portion), the position of the cutter block 50 in the direction toward and away from the cutting edge portion 34 is determined.

<Modification of Method for Attaching Cutter Block 50 to Cuttable Portion 22>

As long as the cutter block 50 is prevented from coming off the cuttable portion 22, the cutter block 50 may be attached to the cuttable portion 22 while being allowed to move in a direction along the surface of the cuttable portion 22 (including the longitudinal direction).

A hole that extends in the longitudinal direction of the cuttable portion 22 may be formed in the cutter block 50, and the cuttable portion 22 may be received by the hole.

Figure 13:
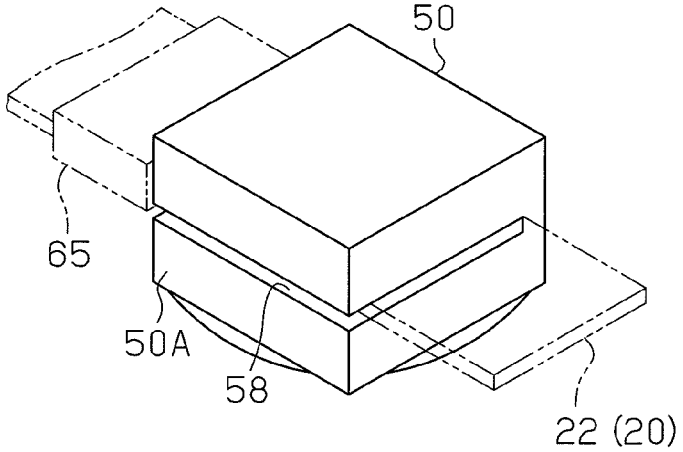
FIG. 13 corresponds to FIG. 5 and is a partial perspective view illustrating a modification of a cutter block.

As shown in FIG. 13, a slit 58 may be formed in the cutter block 50, and the cuttable portion 22 may be received by the slit 58. The slit 58 is open in one of wall surfaces 50A on opposite sides of the cutter block 50 in the width direction of the cuttable portion 22 (substantially the lateral direction of FIG. 13). The cuttable portion 22 is moved in its width direction to be received by the slit 58 at the opening.

Figure 14:
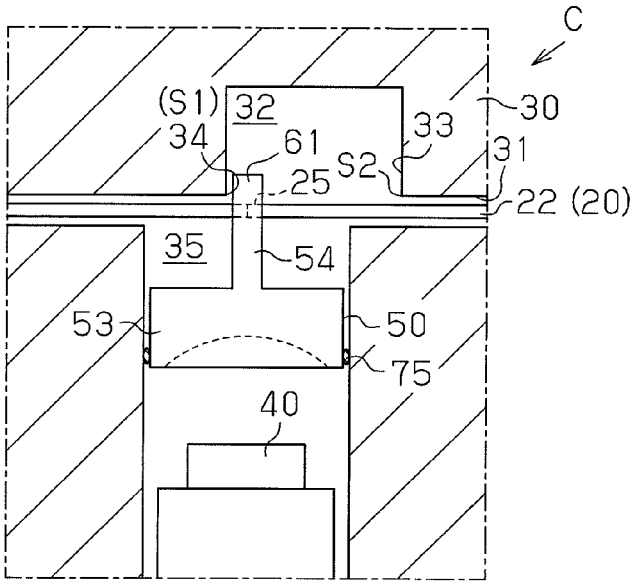
FIG. 14 is a partial cross-sectional view illustrating a modification of a cutter block and a metal conductive body.
Figure 15:
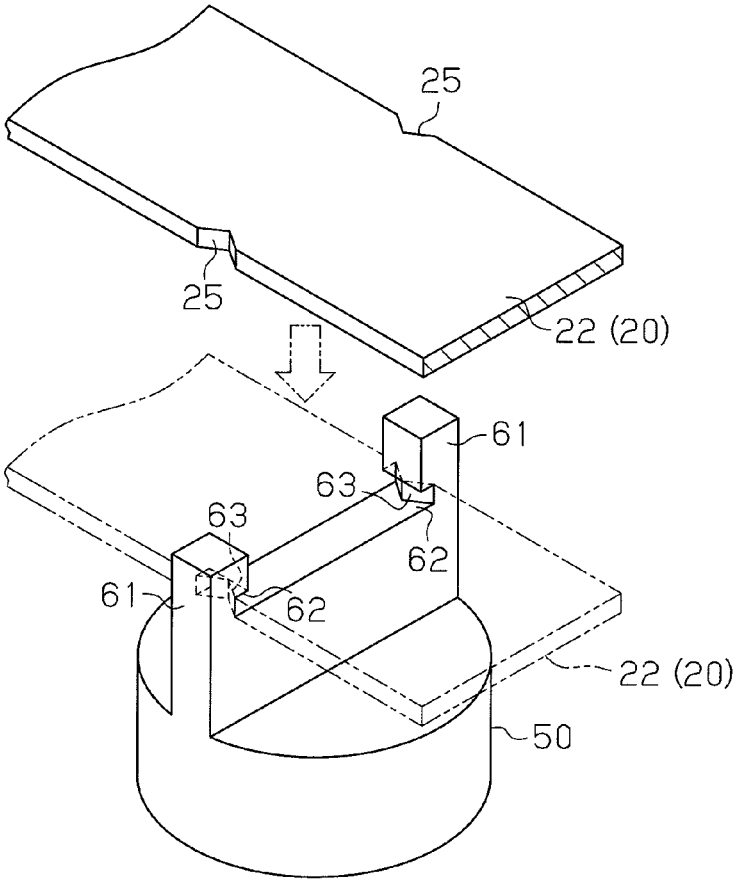
FIG. 15 is a partial perspective view illustrating the cutter block and the metal conductive body of FIG. 14.

As shown in FIGS. 14 and 15, the cutter block 50 may have a pair of pillar portions 61, which protrudes in the thickness direction of the cuttable portion 22 and spaced from each other in the width direction of the cuttable portion 22. Between the pillar portions 61, the cutter block 50 is attached to the cuttable portion 22.

In this case, a pair of notches 25 is formed on both sides of the cuttable portion 22 in the width direction (substantially the lateral direction of FIG. 15). The notches 25 are formed at opposite positions. The notches 25 each may be formed to be triangular such that its width decreases from the side of the cuttable portion 22 toward the center in the width direction of the cuttable portion 22 as shown in FIG. 15.

The pillar portions 61 may have holding recesses 62 on the facing surfaces. Each holding recess 62 has a triangular prism-shaped holding portion 63, which corresponds to the notch 25 of the cuttable portion 22. The width of the holding portion 63 decreases toward the center in the width direction of the cuttable portion 22.

The notches 25 of the cuttable portion 22 are each received by the holding recess 62 of the corresponding pillar portion 61 to be fitted in (engaged with) the holding portion 63, so that the cutter block 50 is attached to the cuttable portion 22 at both pillar portions 61.

Figure 11:
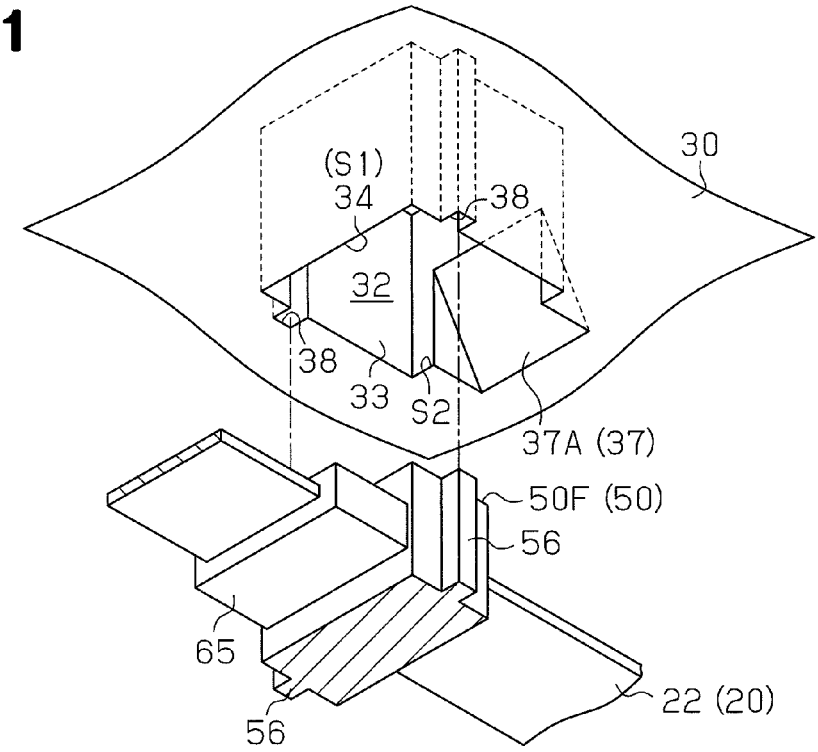
FIG. 11 is a partial perspective view illustrating a modification of a cutting chamber and a cutter block.

Although not illustrated in FIG. 14, an engaging portion and an engageable portion similar to those illustrated in FIG. 11 may be employed. In this case, a pair of grooves 38 is formed in the inner walls of the cutting chamber 32. The grooves 38 function as engageable portions. Each pillar portion 61 may have a protrusion 56, which functions as an engaging portion. Alternatively, without providing the protrusions 56, an outer part of each pillar portion 61 in the width direction of the cuttable portion 22 may be employed as a protrusion 56.

<Modification of Restraining Block 65>

The restraining block 65 is not limited to the one that is formed through insert molding in which the metal conductive body 20 is used as an insert piece. The restraining block 65 may be formed separately from the metal conductive body 20 and then attached to the cuttable portion 22.

<Other Modifications>

The material for forming the case 30, the cutter block 50, the restraining block 65, and the hammer 70 is not limited to plastic, but may be any material as long as it has a sufficient strength for cutting the cuttable portion 22 and an appropriate electrical insulating property. As methods for forming the cutter block 50, the restraining block 65, and the hammer 70, any method may be employed such as a method using a mold and a machining method.

As shown in FIG. 14, an O-ring 75 may be located between the cutter block 50 and the accommodating chamber 35 to determine the position of the cutter block 50 in the thickness direction of the cuttable portion 22 (for example, the up-down direction as viewed in FIG. 14) and to hold the cutter block 50 at that position.

The conduction breaking device C of the present invention is not limited to the one placed between the storage battery 12 and the electric device 13 (the converter 14). The present invention may be applied to any device that is placed between devices in an electric circuit and is designed to break the conduction between the devices. The conduction breaking device of the present invention may be used as a conduction breaking device placed between a fuel cell and a vehicle driving motor in a fuel cell vehicle, a conduction breaking device placed between a power source and an electric device in a stationary system, or a conduction breaking device placed between electric devices in a stationary system.

Therefore, the present examples and embodiments are to be considered as illustrative and not restrictive and the invention is not to be limited to the details given herein, but may be modified within the scope and equivalence of the appended claims.

The invention claimed is:

1. A conduction breaking device for breaking conduction between a pair of devices in an electric circuit, the conduction breaking device comprising:

an elongated plate-shaped metal conductive body, which extends between the devices in the electric circuit and has a cuttable portion in part in a longitudinal direction;

a cutting chamber and a gas generator, which face each other to sandwich the cuttable portion in the thickness direction of the cuttable portion; and a cutter block, which is movable in the thickness direction of the cuttable portion, wherein the cutting chamber has a polygonal opening that faces the cuttable portion, at least one side of the opening forms a cutting edge portion, the gas generator generates gas to move the cutter block in the thickness direction of the cuttable portion, thereby cutting the cuttable portion between the moving cutter block and the cutting edge portion, the cutter block includes a block leading portion and a block trailing portion, the block leading portion covering a surface of the cuttable portion that faces the cutting chamber, and the block trailing portion covering a surface of the cuttable portion that faces the gas generator, and the cutter block is attached to the cuttable portion; and before generation of gas by the gas generator, a part of the cutter block is located in the cutting chamber and at a position close to the cutting edge portion in a direction along the surface of the cuttable portion.

2. The conduction breaking device according to claim 1, wherein the cutter block is fixed to the cuttable portion.

3. The conduction breaking device according to claim 1, wherein the cutting chamber has an engageable portion, the cutter block has an engaging portion at a position that is further away from the gas generator than the cuttable portion, and the engaging portion is engaged with the engageable portion to determine the position of the cutter block in a direction along the surface of the cuttable portion.

4. The conduction breaking device according to claim 1, wherein the cutter block is moved when pushed by pressure of the gas from the gas generator.

5. The conduction breaking device according to claim 1, further comprising a hammer, which is located between the cutter block and the gas generator, wherein the hammer is moved toward the cutting chamber when pushed by pressure of the gas from the gas generator, thereby striking and moving the cutter block.

6. The conduction breaking device according to claim 1, further comprising a restraining block, which is located at a position on the opposite side of the cutting edge portion from the cutter block in the direction along the surface of the cuttable portion, wherein the restraining block restricts movement of the cuttable portion.

7. The conduction breaking device according to claim 1, wherein the opening has a rectangular shape, the cutting edge portion is formed by a first side of the four sides of the opening, the conduction breaking device includes a cutout portion for receiving the cuttable portion, the four sides of the opening include a second side facing the cutting edge portion, and the cutout portion is located in the vicinity of the second side.

* * * * *